US009227451B2

(12) United States Patent
Dolsey et al.

(10) Patent No.: US 9,227,451 B2
(45) Date of Patent: Jan. 5, 2016

(54) HEAT TRANSFER METHODS AND SHEETS FOR APPLYING AN IMAGE TO A SUBSTRATE

(75) Inventors: Russell Dolsey, Roswell, GA (US); Frank J. Kronzer, Woodstock, GA (US)

(73) Assignee: Neenah Paper, Inc., Alpharetta, GA (US)

( * ) Notice: Subject to any disclaimer, the term of this patent is extended or adjusted under 35 U.S.C. 154(b) by 759 days.

(21) Appl. No.: 13/517,159

(22) PCT Filed: Dec. 20, 2010

(86) PCT No.: PCT/US2010/061279

§ 371 (c)(1), (2), (4) Date: Aug. 27, 2012

(87) PCT Pub. No.: WO2011/079067

PCT Pub. Date: Jun. 30, 2011

(65) Prior Publication Data

US 2012/0325401 A1 Dec. 27, 2012

Related U.S. Application Data

(60) Provisional application No. 61/289,103, filed on Dec. 22, 2009.

(51) Int. Cl.
*B44C 1/165* (2006.01)
*B44C 1/17* (2006.01)
(Continued)

(52) U.S. Cl.
CPC ..... *B41M 5/0256* (2013.01)

(58) Field of Classification Search
CPC ..... B41M 3/12; B41M 5/0256; B41M 5/42; B41M 5/52; B41M 7/0027; B44C 1/1712; B44C 1/1716; B44C 1/1756; B05D 5/06; B32B 7/06; B32B 38/14
USPC ..... 156/230, 234, 235, 237, 239, 240, 277
See application file for complete search history.

(56) References Cited

U.S. PATENT DOCUMENTS 4,599,801 A 7/1986 Kronzer et al.
4,863,781 A 9/1989 Kronzer
(Continued)

FOREIGN PATENT DOCUMENTS

WO WO 2009055158 A1 4/2009

OTHER PUBLICATIONS

International Search Report for Appl. No. PCT/US2010/061279.

*Primary Examiner* — Sing P Chan

(57) ABSTRACT

Methods are generally provided of transferring an image to a substrate using a colorless fusible polymer material printed onto a printable surface of a printable transfer sheet to form an imaged area. The printable transfer sheet can be positioned adjacent to a coating transfer sheet such that the imaged area is adjacent to a meltable coating layer of the coating transfer sheet. The meltable coating layer and the imaged area can then be fused together, and the sheets separated to form an intermediate coated imaged sheet, such that the imaged area is coated with the meltable coating layer. The intermediate coated imaged sheet can be positioned adjacent to the substrate such that the imaged area coated with the meltable coating layer is adjacent to substrate, and heat and pressure can be applied. The intermediate coated imaged sheet can be separated from the substrate to leave the imaged area on the substrate.

24 Claims, 6 Drawing Sheets

(51) Int. Cl.

| | |
|---|---|
| ***B32B 37/04*** | (2006.01) |
| ***B32B 37/06*** | (2006.01) |
| ***B32B 38/10*** | (2006.01) |
| ***B32B 38/14*** | (2006.01) |
| ***B41M 5/025*** | (2006.01) |

(56) References Cited

U.S. PATENT DOCUMENTS

| | | | | |
|---|---|---|---|---|
| 5,242,739 | A | 9/1993 | Kronzer et al. | |
| 5,271,990 | A | 12/1993 | Kronzer et al. | |
| 5,370,495 | A | 12/1994 | Montalvo et al. | |
| 5,431,501 | A | 7/1995 | Hale et al. | |
| 5,501,902 | A | 3/1996 | Kronzer | |
| 5,575,877 | A | 11/1996 | Hale et al. | |
| 5,716,900 | A | 2/1998 | Kronzer et al. | |
| 5,798,179 | A | 8/1998 | Kronzer | |
| 5,945,375 | A | 8/1999 | Kronzer | |
| 6,113,725 | A | 9/2000 | Kronzer | |
| 6,200,668 | B1 | 3/2001 | Kronzer | |
| 6,265,053 | B1 | 7/2001 | Kronzer et al. | |
| 6,281,166 | B1 | 8/2001 | Kronzer | |
| 6,428,878 | B1 | 8/2002 | Kronzer | |
| 6,450,633 | B1 | 9/2002 | Kronzer | |
| 6,703,086 | B2 | 3/2004 | Kronzer et al. | |
| 6,916,751 | B1 | 7/2005 | Kronzer | |
| 7,238,410 | B2 | 7/2007 | Kronzer | |
| 7,361,247 | B2 | 4/2008 | Kronzer | |
| 7,364,636 | B2 | 4/2008 | Kronzer | |
| 7,470,343 | B2 | 12/2008 | Kronzer | |
| 7,604,856 | B2 | 10/2009 | Kronzer et al. | |
| 2003/0064313 | A1* | 4/2003 | Aono | 430/126 |
| 2005/0145325 | A1 | 7/2005 | Kronzer | |
| 2006/0019043 | A1 | 1/2006 | Kronzer | |
| 2006/0283540 | A1* | 12/2006 | Kronzer | 156/235 |
| 2008/0160435 | A1* | 7/2008 | Lim et al. | 430/48 |
| 2009/0061351 | A1 | 3/2009 | Kronzer | |
| 2009/0110850 | A1 | 4/2009 | Kronzer | |
| 2009/0136866 | A1 | 5/2009 | Kronzer | |

* cited by examiner

HEAT TRANSFER METHODS AND SHEETS FOR APPLYING AN IMAGE TO A SUBSTRATE

PRIORITY INFORMATION

The present application claims priority to U.S. Provisional Application No. 61/289,103 of Kronzer, et al. filed on Dec. 22, 2009, which is incorporated by reference herein.

BACKGROUND OF THE INVENTION

In recent years, a significant industry has developed which involves the application of customer-selected designs, messages, illustrations, and the like (referred to collectively hereinafter as "images") on articles, such as T shirts, sweat shirts, leather goods, and the like. These images may be commercially available products tailored for a specific end-use and printed on a release or transfer paper, or the customer may generate the images on a heat transfer paper. The images are transferred to the article by means of heat and pressure, after which the release or transfer paper is removed.

Much effort has been directed at generally improving the transferability of an image-bearing laminate (coating) to a substrate. For example, an improved peelable heat transfer material has been described in U.S. Pat. No. 5,798,179, which allows removal of the base sheet immediately after transfer of the image-bearing laminate ("hot peelable heat transfer material") or some time thereafter when the laminate has cooled ("cold peelable heat transfer material"). Moreover, additional effort has been directed to improving the crack resistance and washability of the transferred laminate in applications where the transferred laminate must be able to withstand multiple wash cycles and normal "wear and tear" without cracking or fading.

Heat transfer papers generally are sold in standard printer paper sizes, for example, 8.5 inches by 11 inches. Graphic images are produced on the transferable surface or coating of the heat transfer paper by any of a variety of means, for example, by ink-jet printer, laser-color copier, other toner-based printers and copiers, and so forth. The image and the transferable surface are then transferred to a substrate such as, for example, a cotton T-shirt. In most instances, transfer of the transfer coating to areas of the articles which have no image is necessary due to the nature of the papers and processes employed, but it is not helpful or desirable because the transfer coatings can stiffen the substrates, make them less porous and make them less able to absorb moisture.

Thus, it is desirable that the transferable surface only transfer in those areas where there is an image, reducing the overall area of the substrate that is coated with the transferable coating. Some papers have been developed that are "weedable", that is, portions of the transferable coating can be removed from the heat transfer paper prior to the transfer to the substrate. Weeding involves cutting around the printed areas and removing the coating from the extraneous nonprinted areas. However, such weeding processes can be difficult to perform, especially around intricate graphic designs.

In recent years, a product called Image Clip® Laser Light Heat Transfer Paper commercially available from Neenah Paper, Inc. (Alpharetta, Ga.) has been employed. This product extends the range of images which can be weeded to fine detailed images and simplifies the weeding process. In this process, a special imaging sheet (first transfer sheet) is printed with a toner image and a matched transfer sheet (second transfer sheet) is applied to the first transfer sheet with heat and pressure, resulting in transfer of the second transfer sheet coating to the image of the first transfer sheet when the papers are separated. Little or no coating is transferred in the non-imaged areas. Then, in a second transfer step, the coated image is transferred to a desired substrate. The first transfer step is preferably done at a lower temperature than the second transfer step to avoid transfer in the non-imaged areas. Such processes utilize adhesive properties of the toner to achieve transfer in the first transfer step.

However, when printing light colored images or images containing areas of light coloring and/or shading, insufficient toner could be applied to provide sufficient adhesion for heat transfer purposes, creating a faded or void spot in the image, when using conventional toner printers.

In the case of transfers to dark colored fabrics, it is desirable to have the ability to transfer white, opaque images as well as colored images, and especially to transfer images which contain both colored portions and white portions. Recently a dark fabric transfer paper which is capable of transferring a weeded opaque layer along with a colored image has become available under the name Image Clip® Laser Dark Heat Transfer Paper from Neenah Paper, Inc. (Alpharetta, Ga.). This product functions in essentially the same manner as the Image Clip® Laser Light Heat Transfer Paper. Besides having a white, opaque layer which is transferred with the image, this product also has a light transfer coating on the transfer paper which bears the image. This coating transfers to the substrate along with the image and the coating from the second transfer sheet in the second transfer step. However, this product, like the Image Clip® Laser Light Heat Transfer Paper, also depends on toners for the adhesive in the first transfer step. Thus, it is only possible to transfer colored images. Also, images containing a very light toner coverage might not transfer completely, as is the case for the Image Clip® Laser Light Heat Transfer Paper product.

Therefore, there remains a need in the art for improved heat transfer papers and methods of application. Desirably, the papers and methods provide good image appearance and durability.

SUMMARY OF THE INVENTION

Aspects and advantages of the invention will be set forth in part in the following description, or may be obvious from the description, or may be learned through practice of the invention.

Methods are generally provided of transferring an image to a substrate. In one particular embodiment, a colorless fusible polymer material can be printed onto a printable surface of a printable transfer sheet to form an imaged area. The printable transfer sheet can be positioned adjacent to a coating transfer sheet such that the imaged area on the printable surface of the printable transfer sheet is adjacent to a meltable coating layer of the coating transfer sheet. Heat and pressure can be applied at a first transfer temperature to the printable transfer sheet positioned adjacent to the coating transfer sheet to fuse the imaged area to the meltable coating layer. The printable transfer sheet can then be separated from the coating transfer sheet to form an intermediate coated imaged sheet, such that the imaged area is coated with the meltable coating layer. The intermediate coated imaged sheet can be positioned adjacent to the substrate such that the imaged area coated with the meltable coating layer is adjacent to substrate, and heat and pressure can be applied at a second transfer temperature to the intermediate coated imaged sheet. The intermediate coated imaged sheet can be separated from the substrate to leave the imaged area on the substrate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof to one skilled in the art, is set forth more particularly in the remainder of the specification, which includes reference to the accompanying figures, in which.

Figure 1:
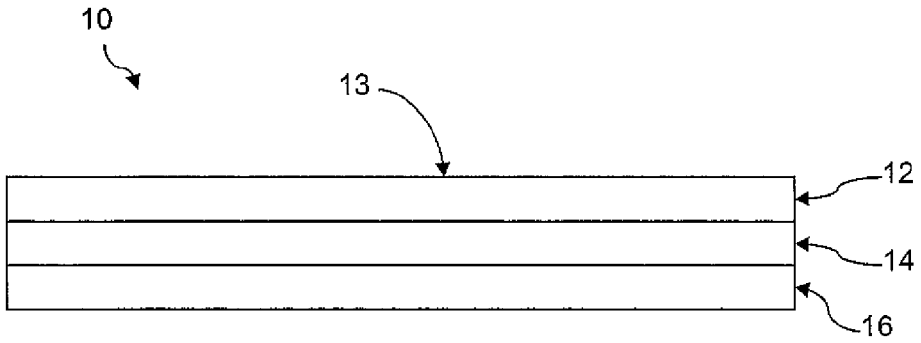
FIG. 1 shows an exemplary printable transfer sheet having release layer forming a printable surface for use in one particular embodiment of the present invention.

Repeat use of reference characters in the present specification and drawings is intended to represent the same or analogous features or elements of the present invention.

DEFINITIONS

As used herein, the term "printable" is meant to include enabling the placement of an image on a material by any means, such as by direct and offset gravure printers, silk-screening, typewriters, laser printers, laser copiers, other toner-based printers and copiers, dot-matrix printers, and ink jet printers, by way of illustration. Moreover, the image composition may be any of the inks or other compositions typically used in printing processes.

The term "colorless fusible polymer material" is used herein to describe a clear, substantially transparent polymeric material or an opaque (i.e., white) polymeric material configured to be printed from a printer and/or copier and adapted to be fused to the printable substrate with heat, in contrast to a "colored ink" that includes a dye, colored pigment, or other colorant. Thus, the "colorless fusible polymer material" could be referred to as a printable, fusible material without any coloring agents present.

The term "molecular weight" generally refers to a weight-average molecular weight unless another meaning is clear from the context or the term does not refer to a polymer. It long has been understood and accepted that the unit for molecular weight is the atomic mass unit, sometimes referred to as the "dalton." Consequently, units rarely are given in current literature. In keeping with that practice, therefore, no units are expressed herein for molecular weights.

As used herein, the term "cellulosic nonwoven web" is meant to include any web or sheet-like material which contains at least about 50 percent by weight of cellulosic fibers. In addition to cellulosic fibers, the web may contain other natural fibers, synthetic fibers, or mixtures thereof. Cellulosic nonwoven webs may be prepared by air laying or wet laying relatively short fibers to form a web or sheet. Thus, the term includes nonwoven webs prepared from a papermaking furnish. Such furnish may include only cellulose fibers or a mixture of cellulose fibers with other natural fibers and/or synthetic fibers. The furnish also may contain additives and other materials, such as fillers, e.g., clay and titanium dioxide, surfactants, antifoaming agents, and the like, as is well known in the papermaking art.

As used herein, the term "polymer" generally includes, but is not limited to, homopolymers; copolymers, such as, for example, block, graft, random and alternating copolymers; and terpolymers; and blends and modifications thereof. Furthermore, unless otherwise specifically limited, the term "polymer" shall include all possible geometrical configurations of the material. These configurations include, but are not limited to isotactic, syndiotactic, and random symmetries.

The term "thermoplastic polymer" is used herein to mean any polymer which softens and flows when heated; such a polymer may be heated and softened a number of times without suffering any basic alteration in characteristics, provided heating is below the decomposition temperature of the polymer. Examples of thermoplastic polymers include, by way of illustration only, polyolefins, polyesters, polyamides, polyurethanes, acrylic ester polymers and copolymers, polyvinyl chloride, polyvinyl acetate, etc. and copolymers thereof.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary construction.

Generally speaking, the present invention is directed to methods of making substrates having coated imaged areas on their surfaces surrounded by uncoated, unimaged areas through the use of a colorless fusible polymer material. Specifically, the present disclosure is directed to methods of heat transferring an image to a substrate such that only the image is coated with the transfer coating layer, leaving the unimaged areas uncoated by the transfer coating layer. Thus, the methods disclose a weedable heat transfer method that can be easily performed by one of ordinary skill in the art without the need to cut around the printed areas to remove the coating from the extraneous, nonprinted areas.

Since no cutting or weeding is required, nearly anyone having a printer and a heat press can utilize the following methods to produce their own customized image for heat transfer to a substrate. Thus, many users that are not currently able to utilize heat transfer methods for applying an image to a substrate can now produce customized images on substrates with their own images without transferring an undesirable background coating or cutting the background areas away (i.e., weeding).

The use of a colorless fusible polymer material is particularly useful for transferring light colored images to the substrate. Such images may normally have little or no toner composition when conventionally printed; however, the use of a colorless fusible polymer material ensures that sufficient fusible material is printed onto the printable sheet enabling heat transfer of the entire image. A colorless fusible polymer material can be used to act as the adhesive in light image areas, greatly increasing the range of colors which could be transferred. In the case of transfers to dark colored fabrics, the use of a colorless fusible polymer material enables transfer of white opaque images and of mixed white/colored images, provided that a white, opaque layer is transferred, as is done using in the Image Clip® Laser Dark Heat Transfer Paper (Neenah Paper, Inc., Roswell, Ga.).

According to one particular embodiment, the method of transferring an image to a substrate utilizes at least two heat transfer papers: a printable transfer sheet and a coating transfer sheet. Each of these sheets are discussed in greater detail below. Various intermediate transfer sheets can be formed during the methods of the present invention. The particular intermediate transfer sheets formed are dependent upon the method selected to form the image.

I. Printing to the Printable Transfer Sheet

According to one particular transfer method, the colorless fusible polymer material can be printed onto a printable transfer sheet to form an imaged area(s). According to this method, the image printed on the printable transfer sheet is the mirror image of the image that will be ultimately transferred to the substrate. Thus, it is desirable to print onto the printable surface the mirror image of the image desired on the substrate. Any number of commercially available software can be utilized to formed and print this mirror image.

FIG. 1 shows an exemplary printable transfer sheet 10 having a printable surface 13. The printable transfer sheet 10 is a multilayer sheet having a release layer 12 overlying a base, or backing, layer 16. The release layer 12 defines the printable surface 13 of the printable transfer sheet 10. An optional conforming layer 14 is shown in the printable transfer sheet 10 between the release layer 12 and the base layer 16. However, the conforming layer 14 may be omitted in certain embodiments such that the release layer 12 is directly on the base layer 16.

Figure 3A:
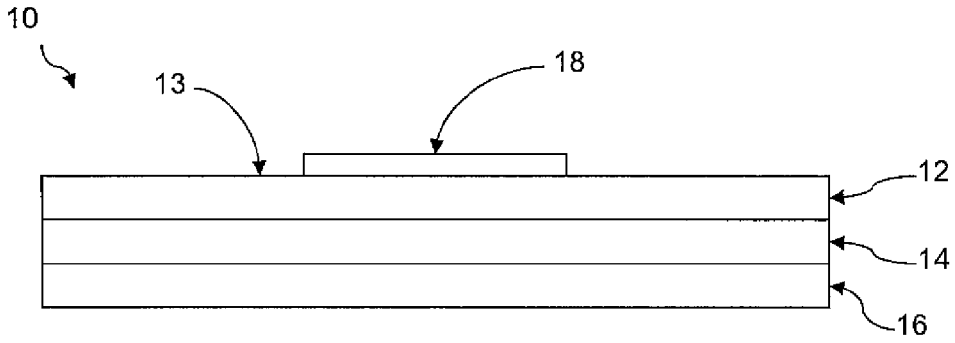
FIGS. 3*a*-3*e* sequentially show an exemplary method for transferring an image to a substrate using the printable transfer sheet of FIG. 1 and the coating transfer sheet of FIG. 2.

FIG. 3*a* shows an image 18 applied (e.g., printed) onto the printable surface 13 of the printable transfer sheet 10. This image 18 includes the colorless fusible polymer material. In certain embodiments, the image 18 can include other toners that include colorants such that the image defines a colored image. In this embodiment, the colorless fusible polymer material can be used selectively in the lightly colored areas to increase the amount of toner in those areas to improve the adhesive qualities of the image for the first heat transfer described below. In one particular embodiment, the entire colored image can be over printed with a colorless fusible polymer material after printing the image using normal ink compositions (e.g., toner compositions). In an alternative embodiment particularly useful for transfers to dark substrates, the entire image can printed using only a colorless fusible polymer material.

The colorless fusible polymer material can be printed via any printer or copier (e.g., laser printers and copiers). Additionally, the colorless fusible polymer material can be printed either in a color printer or copier by replacing one of the cartridges to include a colorless fusible polymer material, or it could be applied with a separate printer, for example a monochrome printer with a single print head. When utilizing a conventional laser printer or copier, a cartridge containing a colorless fusible polymer material can replace the black toner cartridge in the machine for use according to one embodiment of the present invention. In particular embodiments, the image can be formed with a substantially uniform application of a colorless fusible polymer material. For example, the image can be printed conventionally, and then printed over the conventionally printed image using a colorless fusible polymer material to ensure that sufficient toner is present on the printed surface.

The colorless fusible polymer material can be formed from any suitable polymeric resin which can be applied, e.g. by printing, and which will fuse at the first transfer temperature. For example, the colorless fusible polymer material can have a relatively low melting temperature (e.g., less than about 200° C., such as from about 100° C. to about 175° C.) to fuse at the printing and transfer temperatures. Suitable polymeric resins may include, for example, polyesters, polyvinyl acetates, polyurethanes, polystyrene-co-polyalkene (e.g., a styrene butadiene copolymer), polyacrylates, and copolymers (e.g., styrene acrylate copolymer) and mixtures thereof.

The base, or backing, layer 16 of the printable transfer sheet 10 is flexible and has first and second surfaces. The base layer 16 typically will be a film or a cellulosic nonwoven web. In addition to flexibility, the base layer 16 also should have sufficient strength for handling, coating, sheeting, other operations associated with the manufacture of the printable transfer sheet 10, and for transfer of the image 18 to a substrate. The basis weight of the base layer 16 generally may vary from about 30 to about 150 g/m$^2$. By way of example, the base layer 16 may be a paper such as is commonly used in the manufacture of heat transfer papers. In some embodiments, the base layer 16 can be a latex-impregnated paper such as described, for example, in U.S. Pat. No. 5,798,179, the entirety of which is incorporated herein by reference. The base layer 16 is readily prepared by methods that are well known to those having ordinary skill in the art.

The release layer 12 overlays the first surface of the base layer 16 or the optional conformable layer 14. In one embodiment, the release layer 12 has essentially no tack at transfer temperatures. As used herein, the phrase "having essentially no tack at transfer temperatures" means that the release layer 12 does not stick to the image 18 to an extent sufficient to adversely affect the quality of the transfer. The release layer 12 can be fabricated from a wide variety of materials well known in the art of making peelable labels, masking tapes, etc. For example, silicone polymers are very useful and well known. In addition, many types of lattices such as acrylics, polyvinylacetates, polystyrenes, polyvinyl alcohols, polyurethanes, polyvinychlorides, as well as many copolymer lattices such as ethylene-vinylacetate copolymers, acrylic copolymers, vinyl chloride-acrylics, vinylacetate acrylics, other hard acrylic polymers, and so forth, can be used.

In some cases, it may be helpful to add release agents to the release layer 12 such as soaps, detergents, silicones etc., as described in U.S. Pat. No. 5,798,179. The amounts of such release agents can then be adjusted to obtain the desired release properties in the release layer 12. For example, the release enhancing additive may include a divalent metal ion salt of a fatty acid, a polyethylene glycol, a polysiloxane surfactant, or a mixture thereof. More particularly, the release-enhancing additive may include calcium stearate, a polyethylene glycol having a molecular weight of from about 2,000 to about 100,000, a siloxane polymer polyether, or a mixture thereof.

The thickness of the release layer 12 may vary considerably depending upon a number of factors including, but not limited to, the backing layer or conformable layer to be coated. Typically, the release coating layer has a thickness of less than about 2 mil (52 microns). More desirably, the release layer 12 has a thickness of from about 0.1 mil to about 1.0 mil. Even more desirably, the release layer 12 has a thickness of from about 0.2 mil to about 0.8 mil. The thickness of the release layer 12 may also be described in terms of a basis weight, Desirably, the release layer 12 has a basis weight of less than about 45 g/m$^2$. More desirably, the release layer 12 has a basis weight of from about 2 g/m$^2$ to about 25 g/m$^2$. Even more desirably, the release layer 12 has a basis weight of from about 2 g/m$^2$ to about 20 g/m$^2$, and even more desirably from about 4 g/m$^2$ to about 20 g/m$^2$.

The release layer 12 is desirably printable with an image 18 that is to be permanently transferred to a substrate. In particular embodiments, the release layer 12 substantially prevents penetration of the image, including the dyes, pigments and/or toners and the colorless fusible polymer material, into the underlying layer. In this regard, the release coating layer is desirably substantially non-porous.

In one embodiment, the release layer 12 includes a crosslinked polymer. The cross-linked polymer may be formed from a crosslinkable polymeric binder and a crosslinking agent. The crosslinking agent reacts with the crosslinkable polymeric binder to form a 3-dimensional polymeric structure. Generally, it is contemplated that any pair of polymeric binder and crosslinking agent that reacts to form the 3-dimensional polymeric structure may be utilized, crosslinkable polymeric binders that may be used are any that may be cross-linked to form a 3-dimensional polymeric structure. Desirable crosslinking binders include those that contain reactive carboxyl groups. Exemplary crosslinking binders that include carboxyl groups include acrylics, polyurethanes, ethylene-acrylic acid copolymers, and so forth. Other desirable crosslinking binders include those that contain reactive hydroxyl groups. Cross-linking agents that can be used to crosslink binders having carboxyl groups include polyfunctional aziridines, epoxy resins, carbodiimide, oxazoline functional polymers, and so forth. Cross-linking agents that can be used to crosslink binders having hydroxyl groups include melamine-formaldehyde, urea formaldehyde, amine-epichlorohydrin, multi-functional isocyanates, and so forth.

In another embodiment, the release layer 12 may include a polymeric film forming binder and a particulate material. The film forming binder is applied to the base layer so as to form a film on the surface of the printable transfer sheet 10. The particulate material may be, for example, clay particles, powdered thermoplastic polymers, diatomaceous earth particles, and so forth.

The release layer 12 may be formed on a given underlying layer by known coating techniques, such as by roll, blade, Meyer rod, and air-knife coating procedures. The resulting printable transfer sheet 10 then may be dried by means of, for example, steam-heated drums, air impingement, radiant heating, or some combination thereof. A melt-extruded release layer 12 may be applied with an extrusion coater that extrudes molten polymer through a screw into a slot die. The film exits the slot die and flows by gravity onto the base layer 16 (or conforming layer 14, if present). The resulting coated material is passed through a nip to chill the extruded film and bond it to the underlying layer. For less viscous polymers, the molten polymer may not form a self-supporting film. In these cases, the material to be coated may be directed into contact with the slot die or by using rolls to transfer the molten polymer from a bath to the image transfer material.

If desired, the release layer 12 may contain other additives, such as processing aids, release agents, pigments, deglossing agents, antifoam agents, surfactants, pH control agents such as ammonium hydroxide, rheology control agents and the like. The use of these and similar materials is well known to those having ordinary skill in the art.

In another embodiment, the printable transfer sheet may also have a transfer coating overlying the release coating. Such a transfer coating can be designed so as to transfer along with the image in the second transfer step and thus become positioned on top of the image after transfer to the substrate. The advantage of including the transfer coating on the sheet which is imaged is that it carries virtually all of the image from the transfer paper to the desired substrate. The transfer coating may be substantially clear so it does not obscure the transferred image (as in Image Clip® Laser Dark Heat Transfer Paper), or it may contain colorants or white pigments. (For example, Neenah Paper Koncert T's Heat Transfer Paper kit includes a printable transfer sheet having a white pigmented transfer coating.) Of course, the heat transfer coating of the printable transfer sheet should not become tacky, so as to avoid adhesion of the transfer coating in un-imaged areas to the second transfer sheet in the first transfer step or to the substrate in the second transfer step.

Figure 4:
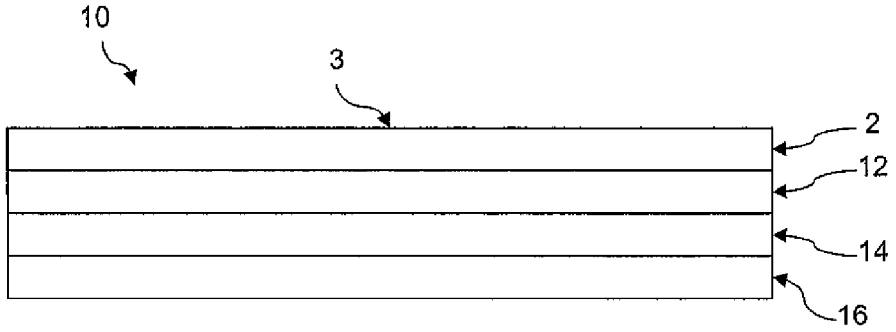
FIG. 4 shows a printable transfer sheet having a transfer coating forming a printable surface for use in one particular embodiment of the present invention.
Figure 5A:
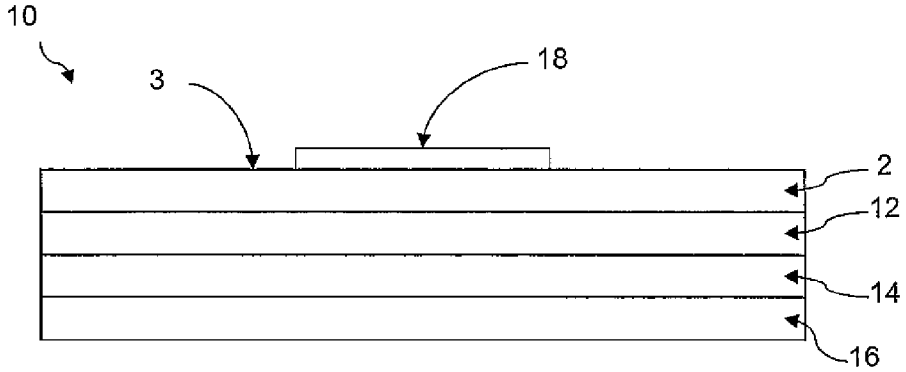
FIGS. 5*a*-5*e* sequentially show an exemplary method for transferring an image to a substrate using the printable transfer sheet of FIG. 4 and the coating transfer sheet of FIG. 2.

For example, FIG. 4 shows a printable transfer sheet 10 including a transfer coating 2 overlying the release coating 12. Thus, the transfer coating 2 defines a printable surface 3 on the printable transfer sheet 10. The transfer coating 2 can be formed on a transfer sheet 10 similar to that shown in FIG. 1 (e.g., having a release layer 12, overlying a base, or backing, layer 16 with an optional conforming layer 14 therebetween). FIG. 5*a* shows an image 18 applied (e.g., printed) onto the printable surface 3 of the printable transfer sheet 10.

II. First Heat Transfer

Figure 2:
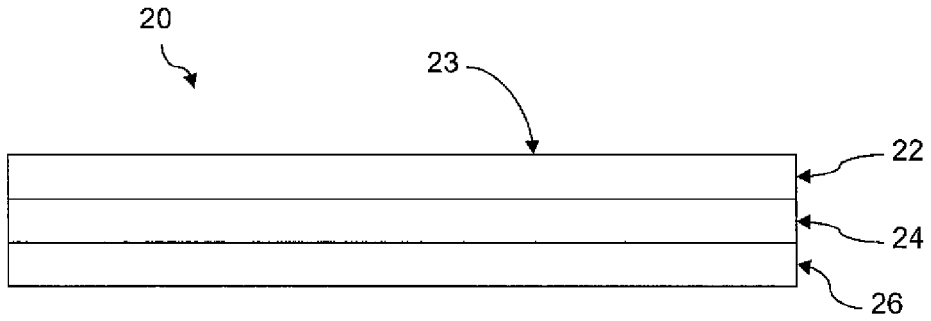
FIG. 2 shows an exemplary coating transfer sheet having a meltable coating layer for use in one particular embodiment of the present invention.

Once an image 18 is printed onto the printable surface 13 of the printable transfer sheet 10, the image can be coated by a meltable coating composition via a first heat transfer with a coating transfer sheet. An exemplary coating transfer sheet 20 is shown having a meltable coating layer 22 in FIG. 2. The meltable coating layer 22 overlays a release layer 24, which overlays a base layer 26. Thus, the meltable coating layer 22 defines an exterior surface 23 of the coating transfer sheet 10. Although shown as two separate layers in FIG. 2, the release layer 24 can be incorporated within the base layer 26, so that they appear to be one layer having release properties.

As mentioned above, the meltable coating layer 22 overlays the base layer 26 and the release layer 24. The basis weight of the meltable coating layer 22 generally may vary from about 2 to about 70 g/m$^2$. Desirably, the basis weight of the meltable coating layer 22 may vary from about 20 to about 50 g/m$^2$, more desirably from about 25 to about 45 g/m$^2$. The meltable coating layer 22 includes one or more coats or layers of a film-forming binder and a powdered thermoplastic polymer over the base layer and release layer. The composition of the coats or layers may be the same or may be different. Desirably, the meltable coating layer 22 will include greater than about 10 percent by weight of the film-forming binder and less than about 90 percent by weight of the powdered thermoplastic polymer. In one particular embodiment, the meltable coating layer 22 includes from about 40% to about 75% of the powdered thermoplastic polymer and from about 20% to about 50% of the film-forming binder (based on the dry weights), such as from about 50% to about 65% of the powdered thermoplastic polymer and from about 25% to about 40% of the film-forming binder.

In general, each of the film-forming binder and the powdered thermoplastic polymer can melt in a range of from about 65° C. to about 180° C. For example, each of the film-forming binder and powdered thermoplastic polymer may melt in a range of from about 80° C. to about 120° C. Manufacturers' published data regarding the melt behavior of film-forming binders or powdered thermoplastic polymers correlate with the melting requirements described herein. It should be noted, however, that either a true melting point or a softening point may be given, depending on the nature of the material. For example, materials such as polyolefins and waxes, being composed mainly of linear polymeric molecules, generally melt over a relatively narrow temperature range since they are somewhat crystalline below the melting point. Melting points, if not provided by the manufacturer, are readily determined by known methods such as differential scanning calorimetry. Many polymers, and especially copolymers, are amorphous because of branching in the polymer chains or the side-chain constituents. These materials begin to soften and flow more gradually as the temperature is increased. It is believed that the ring and ball softening point of such materials, as determined, for example, by ASTM Test Method E-28, is useful in predicting their behavior in the present invention.

The molecular weight generally influences the melting point properties of the thermoplastic polymer, although the actual molecular weight of the thermoplastic polymer can vary with the melting point properties of the thermoplastic polymer. In one embodiment, the thermoplastic polymer can have an average molecular weight of about 1,000 to about 1,000,000. However, as one of ordinary skill in the art would recognize, other properties of the polymer can influence the melting point of the polymer, such as the degree of cross-linking, the degree of branched chains off the polymer backbone, the crystalline structure of the polymer when coated on the base layer 16, etc.

The powdered thermoplastic polymer may be any thermoplastic polymer that meets the criteria set forth herein. For example, the powdered thermoplastic polymer may be a polyamide, polyester, ethylene-vinyl acetate copolymer, polyolefin, and so forth. In addition, the powdered thermoplastic polymer may consist of particles that are from about 2 to about 50 micrometers in diameter. Likewise, any film-forming binder may be employed which meets the criteria specified herein. In some embodiments, water-dispersible ethylene-acrylic acid copolymers can be used.

Other additives may also be present in the meltable coating layer 22. For example, surfactants may be added to help disperse some of the ingredients, especially the powdered thermoplastic polymer. For instance, the surfactant(s) can be present in the meltable coating layer up to about 20%, such as from about 2% to about 15%. Exemplary surfactants can include nonionic surfactants, such as a nonionic surfactant having a hydrophilic polyethylene oxide group (on average it has 9.5 ethylene oxide units) and a hydrocarbon lipophilic or hydrophobic group (e.g., 4-(1,1,3,3-tetramethylbutyl)-phenyl), such as available commercially as Triton® X-100 (Rohm & Haas Co., Philadelphia, Pa.). In one particular embodiment, a combination of at least two surfactants is present in the meltable coating layer.

A plasticizer may be also included in the meltable coating layer 22. A plasticizer is an additive that generally increases the flexibility of the final product by lowering the glass transition temperature for the plastic (and thus making it softer). In one embodiment, the plasticizer can be present in the meltable coating layer up to about 40%, such as from about 10% to about 30%, by weight. One particularly suitable plasticizer is 1,4-cyclohexane dimethanol dibenzoate, such as the compound sold under the trade name Benzoflex 352 (Velsicol Chemical Corp., Chicago). Likewise, viscosity modifiers can be present in the meltable coating layer. Viscosity modifiers are useful to control the rheology of the coatings in their application. Also, ink viscosity modifiers are useful for ink jet printable heat transfer coatings, as described in U.S. Pat. No. 5,501,902. A particularly suitable viscosity modifier for ink jet printable coatings is high molecular weight poly(ethylene oxide), such as the compound sold under the trade name Alkox R400 (Meisei Chemical Works, Ltd). The viscosity modifier can be included in any amount, such as up to about 5% by weight, such as about 1% to about 4% by weight.

The release layer 24 is generally included in the coating transfer sheet 20 to facilitate the release of a portion of the meltable coating layer 22 in the first transfer. The release layer 24 can be fabricated similarly to the release layer 12 described above with respect to the printable transfer sheet 10. In one embodiment, the release layer 24 has essentially no tack at transfer temperatures. As used herein, the phrase "having essentially no tack at transfer temperatures" means that the release layer 24 does not stick to the overlying meltable coating layer 22 to an extent sufficient to adversely affect the quality of the transfer.

In order to function correctly, the bonding between the meltable coating layer 22 and the release layer 24 should be such that about 0.01 to 0.3 pounds per inch of force is required to remove the meltable coating layer 22 from the base layer 26 after transfer. If the force is too great, the meltable coating layer 22 or the base layer 26 may tear when it is removed, or it may stretch and distort. If it is too small, the meltable coating layer 22 may undesirably detach in processing. The peel force can be measured by, for example, applying a pressure sensitive tape to the meltable coating and using a device (such as an Instron tensile testor) to measure the peel force.

The layer thickness of the release layer 24 may vary considerably depending upon a number of factors including, but not limited to, the base layer 26 to be coated, and the meltable coating layer 22 applied to it. Typically, the release layer 24 has a thickness of less than about 2 mil (52 microns). More desirably, the release layer has a thickness of about 0.1 mil to about 1.0 mil. Even more desirably, the release layer has a thickness of about 0.2 mil to about 0.8 mil. The thickness of the release layer may also be described in terms of a basis weight. Desirably, the release layer 24 has a basis weight of less than about 45 $g/m^2$, such as from about 2 to about 30 $g/m^2$.

Optionally, the coating transfer sheet 20 may further include a conformable layer (not shown) between the base layer 26 and the release layer 24 to facilitate the contact between the exterior surface 23 of the meltable coating layer 22 and the imaged printable surface 13 of the printable transfer sheet 10 contacted during heat transfer.

The base layer 26 can be any sheet material having sufficient strength for handling the coating of the additional layers, the transfer conditions, and the separation of the meltable coating layer 22 and opposing surface contacted during heat transfer. For example, the base layer 26 can be a film or cellulosic nonwoven web. The exact composition, thickness or weight of the base is not critical to the transfer process since the base layer 26 is discarded. Some examples of possible base layers 26 include cellulosic non-woven webs and polymeric films. A number of different types of paper are suitable for the present invention including, but not limited to, common litho label paper, bond paper, and latex saturated papers. Generally, a paper backing of about 4 mils thickness is suitable for most applications. For example, the paper may be the type used in familiar office printers or copiers, such as Avon White Classic Crest® (Neenah Paper, Inc.), 24 lb per 1300 sq ft.

The layers applied to the base layer 26 to form the coating transfer sheet 20 may be formed on a given layer by known coating techniques, such as by roll, blade, Meyer rod, and air-knife coating procedures. The resulting image transfer material then may be dried by means of, for example, steam-heated drums, air impingement, radiant heating, or some combination thereof.

Figure 3B:
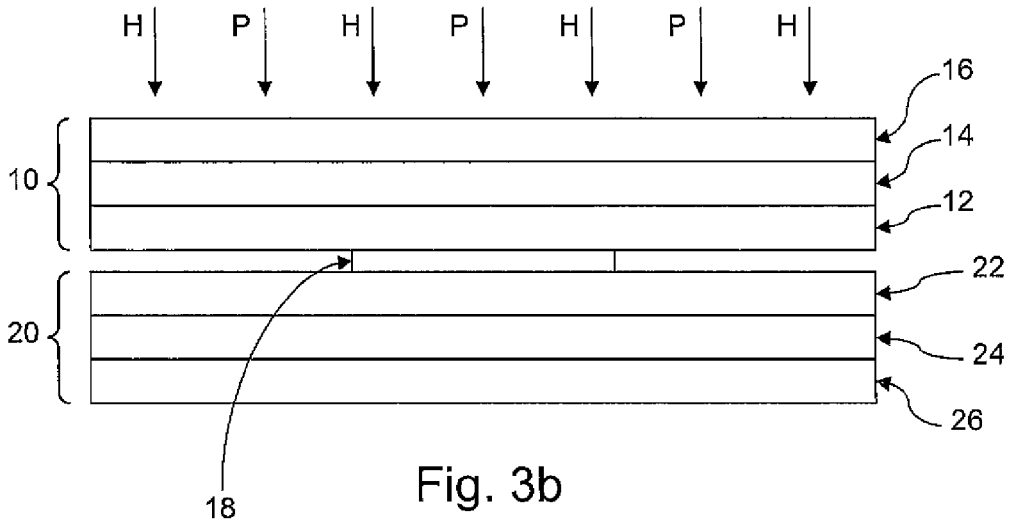

In order to transfer the meltable coating layer 22 to the image 18, the imaged printable transfer sheet 10 is positioned adjacent to the coating transfer sheet 20 such that the image 18 on the printable surface 13 contacts the meltable coating layer 22 of the coating transfer sheet 20, as shown in FIG. 3*b*. Heat (H) and pressure (P) are applied to fuse the colorless fusible polymer material (and toner ink, if present) forming the image 18 to the meltable coating layer 22.

The heat applied in this first transfer is below the temperature where the meltable coating layer 22 substantially melts and/or flows. For instance, the first heat transfer can be carried out at a first transfer temperature below about 275° F., such as from about 200° F. to about 250° F. Thus, upon separation, the image 18 is coated with the meltable coating layer 22 via the adhesive properties of the colorless fusible polymer material (and toner ink, if present) in the image 18, which results in the transfer of the meltable coating layer 22 only in the areas of the printable surface 13 containing the image 18.

Figure 3C:
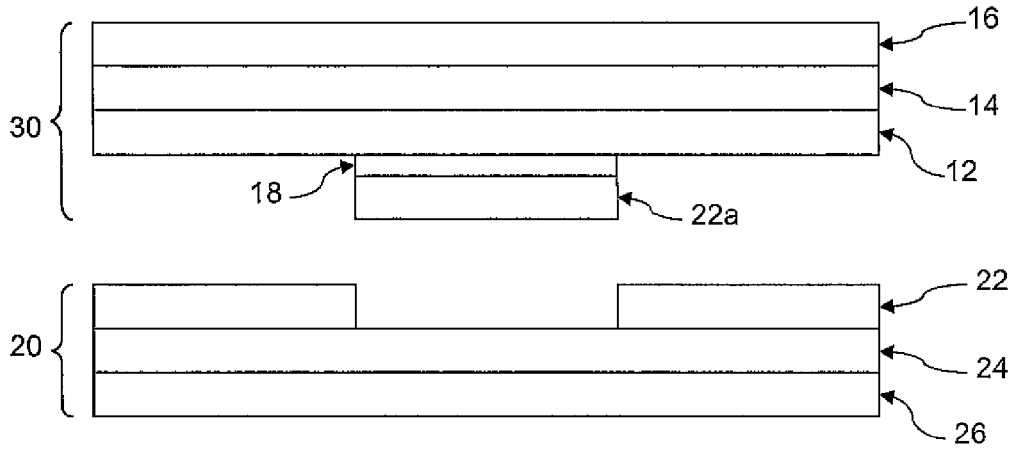

This first heat transfer results in an intermediate coated imaged sheet 30 that has the image 18 coated with the transferred meltable coating layer 22*a* on the imaged areas on the printable surface 13, as shown in FIG. 3*c*.

Figure 5B:
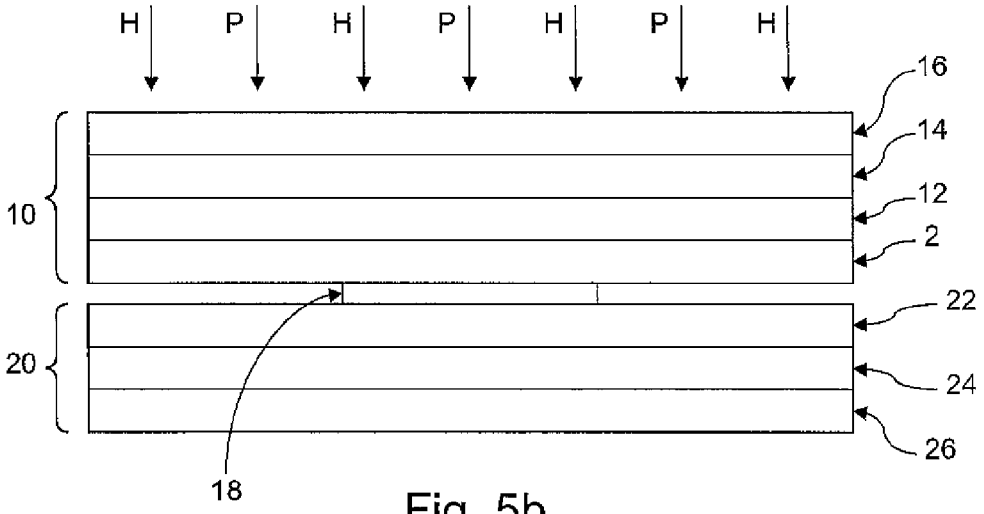
Figure 5C:
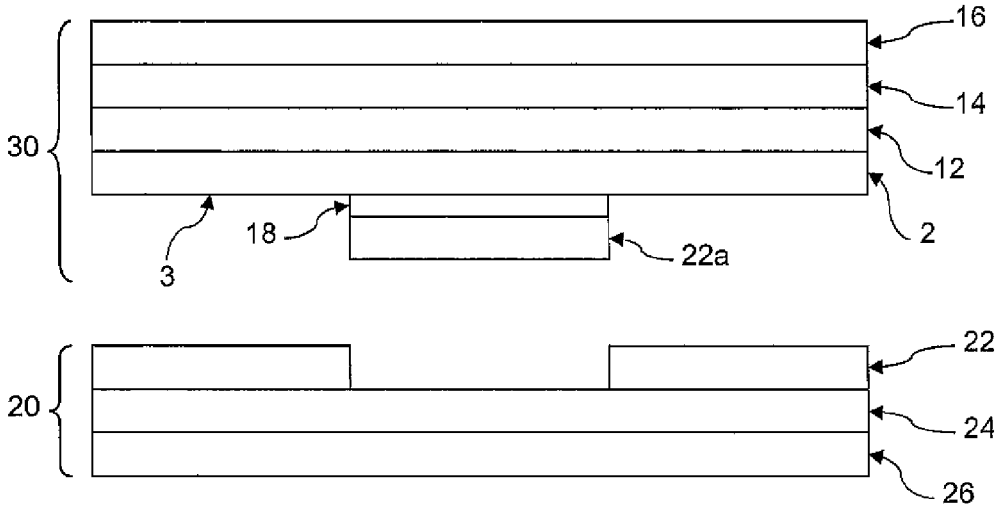

Similarly, FIGS. 5*b* and 5*c* show this first heat transfer using the printable transfer sheet 10 including a transfer coating 2 overlying the release coating 12 of FIG. 4. This transfer resulting in the intermediate coated imaged sheet 30 having the image 18 coated with the transferred meltable coating layer 22*a* on the imaged areas on the printable surface 3, as shown in FIG. 5*c*.

III. Transfer of Coated Image to Substrate

Figure 3D:
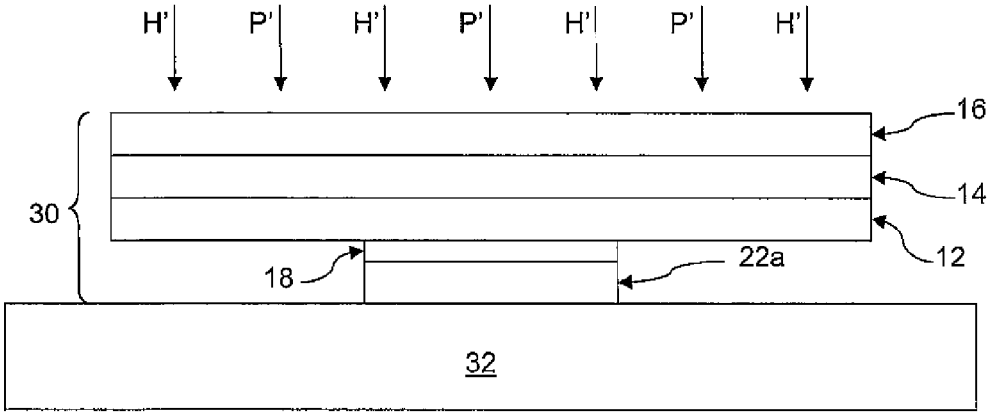

To form the image on a substrate, the intermediate coated imaged sheet 30 can be positioned adjacent to the substrate 32 such that the meltable coating layer 22 over the image 18 directly contacts the substrate 32. Heat (H') and pressure (P') can then be applied to transfer the image 18 to the substrate 32 at a second transfer temperature, as shown in FIG. 3*d*. The second transfer temperature is above the temperature at which the meltable coating layer 22 melts and/or flows, enabling the meltable coating layer 22 to flow onto or into the substrate 32. Thus, the meltable coating layer 22 acts as an adhesive and/or anchor to the image 18 on the substrate 32. The second transfer temperature can be, for instance, above about 300° F., such as from about 315° F. to about 400° F. (e.g., from about 325° F. to about 375° F.).

Figure 3E:
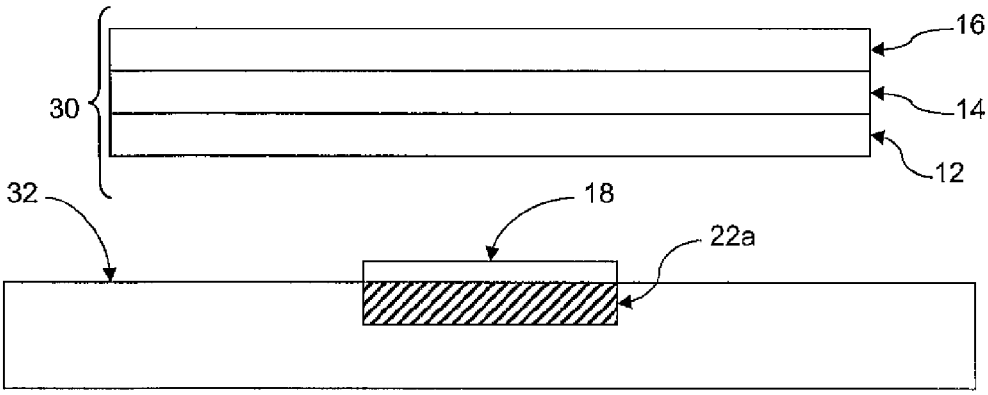

The adhesion strength of the image 18 to the meltable coating layer 22 is stronger than the adhesion strength of the image to the release layer 12. Referring to FIG. 3*e*, the intermediate coated imaged sheet 30 is removed from the substrate 32, leaving the meltable coating layer 22*a* and the image 18 attached to the substrate. As such, upon separation of the intermediate coated imaged sheet 30 from the substrate 32 after transfer, the image 18 remains on the substrate 32. Separation can be performed while the temperature of the materials are still hot (i.e., hot peel) or after the materials have cooled from the transfer temperatures (i.e., cold peel).

Figure 5D:
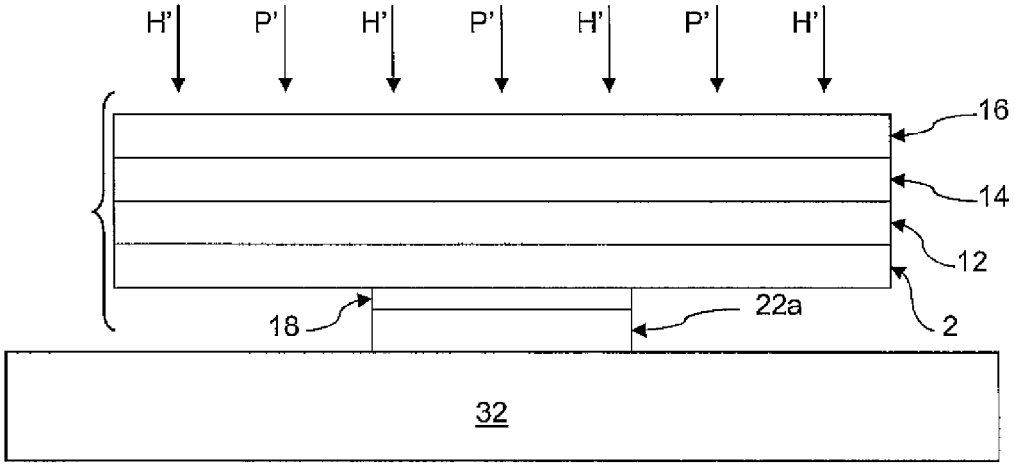
Figure 5E:
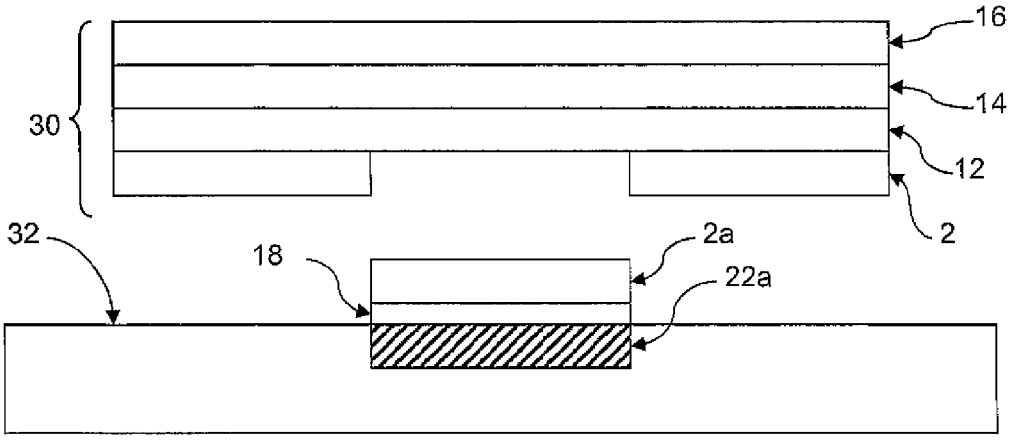

Likewise, FIGS. 5*d* and 5*e* show this transfer of the coated image to the substrate 32 using the intermediate coated imaged sheet 30 that includes the transfer coating 2. In this embodiment, the transfer coating 2 corresponding to the image 18 is transferred along with the image 18 (shown in the transferred transfer coating 2*a*) due to the adhesive characteristics of the colorless fusible polymer material in the image 18. However, the absence of the colorless fusible polymer material in the unimaged areas results in substantially no transfer of the transfer coating 2 in these areas since the transfer coating 2 does not substantially melt or flow at the transfer temperatures.

In one particular embodiment, the transfer coating 2 can be constructed from a crosslinked binder and crosslinked thermoplastic particles to prevent the transfer coating 2 from melting or flowing at the transfer temperature. When the image to be transferred is an opaque image, the transfer coating can include an opacifier or other pigment to add color to the image, which is especially useful for transferring a light colored (e.g., white) image to a dark substrate.

In one particular embodiment, the substrate 32 can be a fabric, such as a woven cloth material (e.g., 100% cotton T-shirt material). Of course, other porous and non-porous substrates may also be used.

EXAMPLE 1

A colorless ink, available under the name ElectroInk White from Hewlett-Packard (Palo Alto, Calif.) was printed onto an imaging sheet (Image Clip Laser Dark imaging sheet from Neenah Paper, Inc., Roswell Ga.) using an HP Indigo 7500 Digital Press. The ElectoInk White is a colorless, white toner.

The imaged sheet was then heat pressed with a transfer sheet (Image Clip Laser Dark transfer sheet from Neenah Paper, Inc., Roswell Ga.) at a first transfer temperature of about 120° C. for 20 seconds using a heat press. The two sheets were then separated while still hot. This first heat transfer step resulted in a clean transfer of the meltable coating layer of the transfer sheet to only the imaged areas of the imaging sheet.

The coated image was then transferred to a 100% cotton T-shirt using a heat press second transfer temperature of about 190° C. for 25 seconds using a heat press. The imaging sheet was then peeled from the T-shirt upon cooling. This second heat transfer step resulted in a clean transfer of the image to the T-shirt, only in the imaged areas.

EXAMPLE 2

A colorless ink, available under the name ElectroInk White from Hewlett-Packard (Palo Alto, Calif.) was printed onto a color image already printed onto an imaging sheet (Image Clip Laser Dark imaging sheet from Neenah Paper, Inc., Roswell Ga.) using an HP Indigo 7500 Digital Press. The color image was previously printed on the imaging sheet using conventional toner inks and contained areas of dark coloring and light coloring.

The imaged sheet was then heat pressed with a transfer sheet (Image Clip Laser Dark transfer sheet from Neenah Paper, Inc., Roswell Ga.) at a first transfer temperature of about 120° C. for 20 seconds using a heat press. The two sheets were then separated while still hot. This first heat transfer step resulted in a clean transfer of the meltable coating layer of the transfer sheet to only the imaged areas of the imaging sheet. The colorless toner ink facilitated transfer of the coating to the colored image, especially in areas where the colored image was defined by light coloring.

The coated image was then transferred to a 100% cotton T-shirt using a heat press second transfer temperature of about 190° C. for 25 seconds using a heat press. The imaging sheet was then peeled from the T-shirt upon cooling. This second heat transfer step resulted in a clean transfer of the image to the T-shirt, only in the imaged areas.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed:

1. A method of transferring an image to a substrate, the method comprising printing a colorless fusible polymer material onto a printable surface of a printable transfer sheet to form an imaged area, wherein the printable transfer sheet comprises a release layer defining the printable surface and a base layer;

positioning the printable transfer sheet adjacent to a coating transfer sheet such that the imaged area on the printable surface of the printable transfer sheet is adjacent to a meltable coating layer of the coating transfer sheet;

applying heat and pressure at a first transfer temperature to the printable transfer sheet positioned adjacent to the coating transfer sheet to fuse the imaged area to the meltable coating layer;

separating the printable transfer sheet from the coating transfer sheet to form an intermediate coated imaged sheet, wherein the imaged area is coated with the meltable coating layer;

positioning intermediate coated imaged sheet adjacent to the substrate such that the imaged area coated with the meltable coating layer is adjacent to substrate;

applying heat and pressure at a second transfer temperature to the intermediate coated imaged sheet; and separating the intermediate coated imaged sheet from the substrate to leave the imaged area on the substrate, wherein the imaged area left on the substrate comprises the colorless fusible polymer material on the meltable coating layer.

2. The method of claim 1, further comprising:

printing an ink composition onto the printable surface of the printable transfer sheet to form a color image.

3. The method of claim 2, wherein the imaged area comprising the colorless fusible polymer material corresponds to the color image formed by the ink composition.

4. The method of claim 1, wherein the imaged area consists essentially of the colorless fusible polymer material.

5. The method of claim 4, wherein the meltable coating layer comprises an opacifier.

6. The method of claim 1, wherein the meltable coating layer comprises thermoplastic particles and a film forming binder.

7. The method of claim 1, wherein the first transfer temperature is below the melting point of the meltable coating layer.

8. The method of claim 1, wherein the first transfer temperature is less than about 275° F.

9. The method of claim 1, wherein the first transfer temperature is from about 200° F. to about 250° F.

10. The method of claim 1, wherein the second transfer temperature is above the melting point of the meltable coating layer.

11. The method of claim 1, wherein the second transfer temperature is above about 300° F.

12. The method of claim 1, wherein the second transfer temperature is from about 315° F. to about 400° F.

13. A method of transferring an image to a substrate, the method comprising printing a colorless fusible polymer material onto a printable surface of a printable transfer sheet to form an imaged area, wherein the printable transfer sheet comprises a transfer layer defining the printable surface, wherein the transfer layer overlies a release layer and a base layer;

positioning the printable transfer sheet adjacent to a coating transfer sheet such that the imaged area on the printable surface of the printable transfer sheet is adjacent to a meltable coating layer of the coating transfer sheet;

applying heat and pressure at a first transfer temperature to the printable transfer sheet positioned adjacent to the coating transfer sheet to fuse the imaged area to the meltable coating layer;

separating the printable transfer sheet from the coating transfer sheet to form an intermediate coated imaged sheet, wherein the imaged area is coated with the meltable coating layer;

positioning intermediate coated imaged sheet adjacent to the substrate such that the imaged area coated with the meltable coating layer is adjacent to substrate;

applying heat and pressure at a second transfer temperature to the intermediate coated imaged sheet; and separating the intermediate coated imaged sheet from the substrate to leave the imaged area on the substrate, wherein the imaged area left on the substrate comprises the colorless fusible polymer material on the meltable coating layer, and wherein the imaged area on the substrate is coated with the transfer coating.

14. The method of claim 13, further comprising:

printing an ink composition onto the printable surface of the printable transfer sheet to form a color image.

15. The method of claim 14, wherein the imaged area comprising the colorless fusible polymer material corresponds to the color image formed by the ink composition.

16. The method of claim 13, wherein the imaged area consists essentially of the colorless fusible polymer material.

17. The method of claim 16, wherein the transfer coating comprises an pacifier.

18. The method of claim 13, wherein the meltable coating layer comprises thermoplastic particles and a film forming binder.

19. The method of claim 13, wherein the first transfer temperature is below the melting point of the meltable coating layer.

20. The method of claim 13, wherein the first transfer temperature is less than about 275° F.

21. The method of claim 13, wherein the second transfer temperature is above the melting point of the meltable coating layer.

22. The method of claim 13, wherein the second transfer temperature is above about 300° F.

23. The method of claim 13, wherein the transfer coating does not appreciably melt or flow at the second transfer temperature.

24. The method of claim 13, wherein unimaged areas on the substrate are substantially free from any transfer coating.

* * * * *